United States Patent [19]

Redding et al.

[11] 4,214,746

[45] Jul. 29, 1980

[54] SORTING APPARATUS

[75] Inventors: Thomas P. Redding, Penfield; Glenn M. Herbert; Alistair J. Caldwell, both of Rochester, all of N.Y.

[73] Assignee: Xerox Corporation, Stamford, Conn.

[21] Appl. No.: 3,441

[22] Filed: Jan. 15, 1979

[51] Int. Cl.[3] ..... B65H 39/11

[52] U.S. Cl. ..... 271/294; 271/293

[58] Field of Search ..... 271/292, 293, 294, 287, 271/290, 279, 213; 270/58; 414/47, 43, 51, 53

[56] References Cited

U.S. PATENT DOCUMENTS

| | | | |
|---|---|---|---|
| 3,131,819 | 5/1964 | Ducayet | 271/279 X |
| 3,273,882 | 9/1966 | Pearson | 271/292 |
| 3,395,913 | 8/1968 | Del Vecchio et al. | 271/292 X |
| 3,516,654 | 6/1970 | Mestre | 271/294 |
| 3,561,753 | 2/1971 | Snellman | 271/290 X |
| 3,740,050 | 6/1973 | Jacobs | 271/292 |
| 3,788,640 | 1/1974 | Stemmle | 271/293 |
| 3,848,867 | 11/1974 | Johnson | 271/290 |
| 3,995,748 | 12/1976 | Looney | 271/293 X |

*Primary Examiner*—Bruce H. Stoner, Jr.

*Attorney, Agent, or Firm*—J. J. Ralabate; C. A. Green; H. Fleischer

[57] ABSTRACT

A sorting apparatus in which a sheet loading station is arranged to advance sheets into individual sheet receiving members of one of at least two groups of sheet receiving members. The other group of sheet receiving members is positioned at one of two sheet unloading stations. After loading and unloading sheets from the respective groups of sheet receiving members, the loaded group of sheet receiving members moves to the other sheet unloading station as the unloaded group of sheet receiving members returns to the sheet loading station.

6 Claims, 9 Drawing Figures

SORTING APPARATUS

This invention relates generally to a sorting apparatus coupled to a printing machine, and more particularly concerns an improved system for collecting and sorting sheets into collated sets.

A reproducing machine, such as an electrophotographic printing machine, includes a photoconductive member which is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing the developer mix into contact therewith. Generally, the developer mix comprises carrier granules having toner particles adhering triboelectrically thereto. The toner particles are attracted from the carrier granules to the latent image forming a toner powder image on the photoconductive member. The toner powder image is then transferred from the photoconductive member to a copy sheet. Finally, the copy sheet is heated to permanently affix the toner particles thereto in image configuration. This general approach was disclosed by Carlson in U.S. Pat. No. 2,297,691, and has been further amplified and described by many related patents in the art.

Frequently, it is highly desirable to reproduce a plurality of copies of the same original document, or if several original documents are being reproduced, a plurality of collated sets of copies. This may be achieved by the utilization of a sorting apparatus.

In the past, sorting systems included large and bulky bin modules with a multitude of trays arranged for movement relative to the sheet path for increased storage. One typical sorter employs tray members which are spaced apart and extend in a linear row. Another type of sorting apparatus has trays extending radially outwardly from the axis of rotation. Copy sheets may be collected in the bins of the sorter in a number of ways. The most common technique is to utilize the sheet transport to advance the copy sheets past the bin openings and deflection fingers to guide the sheets from the transport into the respective bin. Alternatively, the deflection fingers could move from bin to bin so as to deflect the copy sheets into the selected bin. Still yet another approach is to move the bins past the sheet ejecting portion of the transport. In this manner, the bins of the sorting apparatus collected the various sheets forwarded thereto. However, sorting systems of this type frequently had limitations in the number of copy sheets that could be collected or their size was extremely large and did not readily lend itself to compact printing machines.

Various types of sorters have hereinbefore been developed for collecting sheets. The following prior art appears to be relevant:

| | |
|---|---|
| U.S. Pat. No.: | 3,273,882 |
| Patentee: | Pearson |
| Issued: | September 20, 1966 |

-continued

| | |
|---|---|
| U.S. Pat. No.: | 3,395,913 |
| Patentee: | Del Vecchio |
| Issued: | August 6, 1968 |
| U.S. Pat. No.: | 3,516,654 |
| Patentee: | Mestre |
| Issued: | June 23, 1970 |
| U.S. Pat. No.: | 3,561,753 |
| Patentee: | Snellman |
| Issued: | February 9, 1971 |
| U.S. Pat. No.: | 3,740,050 |
| Patentee: | Jacobs |
| Issued: | June 19, 1973 |
| U.S. Pat. No.: | 3,788,640 |
| Patentee: | Stemmle |
| Issued: | January 29, 1974 |
| U.S. Pat. No.: | 3,848,867 |
| Patentee: | Johnson |
| Issued: | November 19, 1974 |
| U.S. Pat. No.: | 3,995,748 |
| Patentee: | Looney |
| Issued: | December 7, 1976 |

The pertinent portions of the foregoing prior art may be briefly summarized as follows:

Pearson discloses a sorter having a plurality of stationary shelves. Tapes advance the sheets past the shelves. A column of deflecting fingers are disposed in front of the shelves. The fingers are sequentially triggered to deflect successive sheets into the respective shelves.

Del Vecchio describes a sorter in which sheets are advanced by rollers to a diverter comprising a gate. A cam actuates the appropriate gate to guide the sheets into the selected catch tray.

Mestre discloses a sorter having a plurality of pockets and a ramp for guiding the sheets into the pockets. The delivery end of the ramp is indexed to successive pockets. After the first sheet of pockets has had sheets delivered thereto, a second stack of pockets is moved into the sheet delivery position and the ramp returned to its initial position.

Snellman describes a sorter having a plurality of stationary bins. A vacuum conveyor transports the sheets past the bins. A deflector also travels past the bins. The control system positions the deflector at the selected bin and the deflector strips the sheet from the transport and guides it into the bin.

Jacobs describes a sorter employing a plurality of magazines having fingers for guiding the sheets into the respective magazine.

Stemmle discloses a sorter employing a plurality of trays for receiving sheets at a sheet receiving zone. The trays are supported by elongated cams. Rotation of the cams moves the trays past the sheet receiving zone to receive sheets therein.

Johnson describes a sorter in which a sheet advances along a path past the entrance to various stations. The sheets are deflected out of the path into a station by a movable deflector that traverses vertically past the stations.

Looney discloses a sorter having two sets of vertical bins of trays. The bins move vertically so as to be successively aligned with the inlet and discharge stations. After one set of bins has been filled with copy sheets, the sorter rotates positioning the unfilled set of bins on the inlet side and the filled set of bins at the discharge side.

It is a primary object of the present invention to improve the collecting and distributing of sheets by employing a compact apparatus having limitless sorting capabilities.

Briefly stated, and in accordance with with the present invention, there is provided an apparatus for sorting sheets including at least two groups of sheet receiving members. Each group of receiving members comprises a series of individual sheet receiving members arranged to receive and discharge sheets therefrom. A sheet loading station is arranged to advance sheets into the individual sheet receiving members of the two groups of sheet receiving members. One of the sheet unloading stations is arranged to have one of the two groups of sheet receiving members positioned thereat for removing sheets therefrom. The other of the sheet unloading stations is arranged to have the other of the two groups of sheet receiving members positioned thereat for removing sheets therefrom. Moving means is coupled to the two groups of sheet receiving members. In this manner, one of the two groups of sheet receiving members moves to one of the two sheet unloading stations with the other group of sheet receiving members being moved to the sheet loading station so as to bring individual sheet receiving members into position for receiving sheets thereat. After sheets have been loaded and unloaded from the respective group of sheet receiving members, the loaded group of sheet receiving members moves to the other sheet unloading station with the unloaded group of sheet receiving members being moved to the sheet loading station. This enables each of the two groups of sheet receiving members to have sheets loaded and unloaded from the individual sheet receiving members thereof.

Other objects and advantages of the present invention will become apparent as the following description proceeds and upon reference to the drawings, in which:

FIG. 6(*b*) is a schematic elevational view showing one group of trays of the FIG. 1 sorting apparatus after the sheets have been loaded therein;

FIG. 6(*c*) is a schematic elevational view illustrating one group of trays of the FIG. 1 sorting apparatus being unloaded and the other group of trays being loaded; and FIG. 6(*d*) is a schematic elevational view showing one group of trays of the FIG. 1 sorting apparatus being unloaded and the other group of trays after the sheets have been loaded therein.

Figure 1:
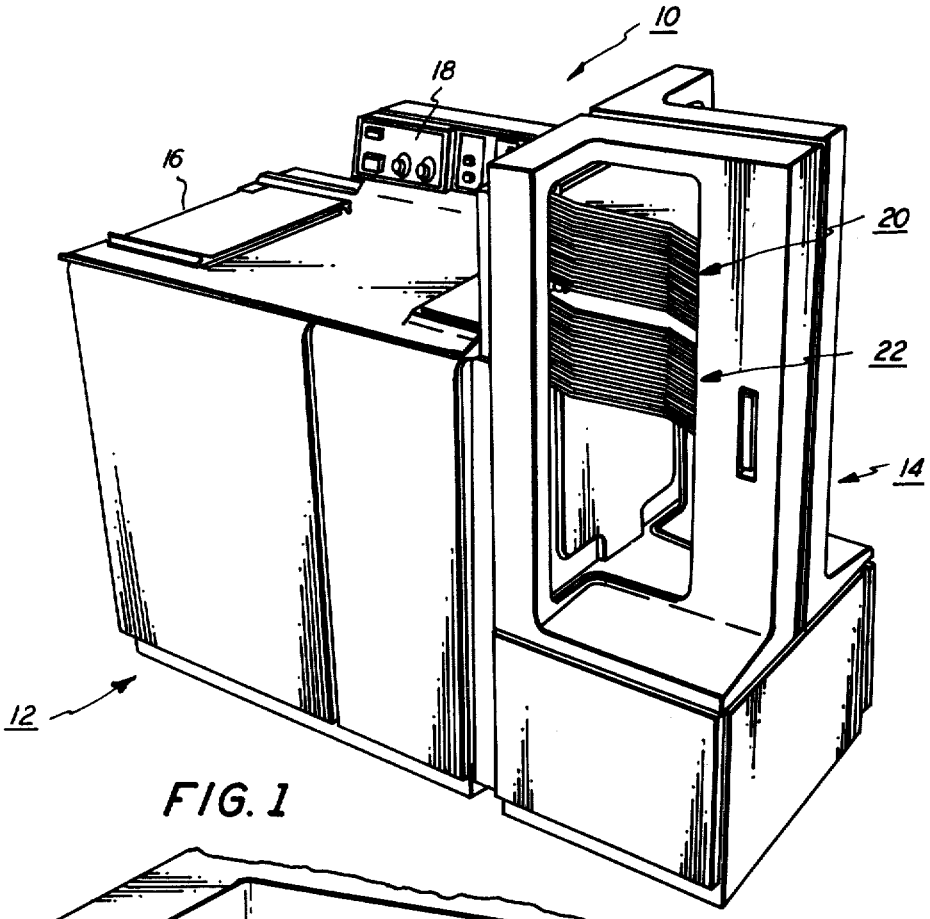
FIG. 1 is a perspective view depicting a reproduction system employing a sorting apparatus having the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the illustrative reproduction system including a copying machine coupled to a sorting apparatus having the features of the present invention incorporated therein, reference is had to the drawings. In the drawings, like reference numerals have been used throughout to designate identical elements. Although the sorting apparatus is particularly well adapted for use with a copying machine, it will become evident from the following discussion that it is equally well suited for use with a wide variety of printing machines and is not necessarily limited in its application to the particular embodiment shown herein.

As illustrated in FIG. 1, the reproduction system, indicated generally by the reference numeral 10, includes a copying machine, preferably an electrophotographic printing machine, designated generally by the reference numeral 12, and a sorting apparatus, indicated generally by the reference numeral 14. Electrophotographic printing machine 12 is capable of producing simplex or duplex copies at the option of the machine operator. Printing machine 12 has a platen 16 for receiving documents to be reproduced and a control panel 18 for selecting different modes of operation such as simplex and duplex copying and the number of copies required to be reproduced. In accordance with the invention, the electrophotographic printing machine 12 is coupled to sorting apparatus 14. Sorting apparatus 14 has two groups of sheet receiving members or trays. In operation, one group of trays, designated generally by the reference numeral 20, is in the sheet loading position while the other group of trays, designated generally by the reference numeral 22, is in the sheet unloading position. Preferably, each group of trays comprises ten trays. After the first group of trays 22 has received copy sheets, the next group of trays 20 is moved from the sheet unloading station to the sheet loading station. As the sheets are loaded into the second group of trays 20, sheets are unloaded from the first group of trays 22. The foregoing is shown more clearly in FIG. 2.

Figure 2:
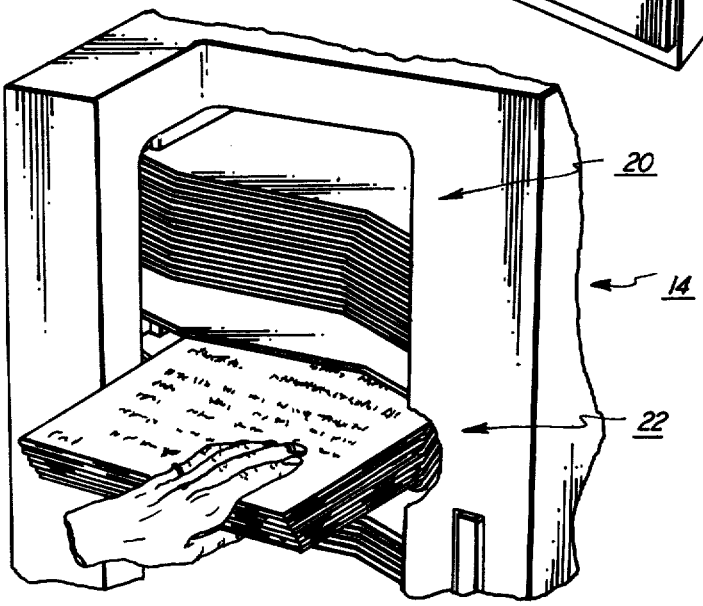
FIG. 2 is a fragmentary exploded perspective view showing the sheets being unloaded from the FIG. 1 soring apparatus.

Referring now to FIG. 2, an operator is shown unloading sets of collated copies from the first group of trays 22. This group of trays 22 has advanced to the sheet unloading station. Simultaneously therewith, the second group of trays 20 has advanced to the sheet loading position and copies are being advanced to the respective trays thereof. In unloading the collated sets of copies from the first group of trays 22, the operator removes the collated sets from the front of the copy machine. Contrariwise, the sheets are loaded into the second group of trays 20 from the side thereof.

Figure 3:
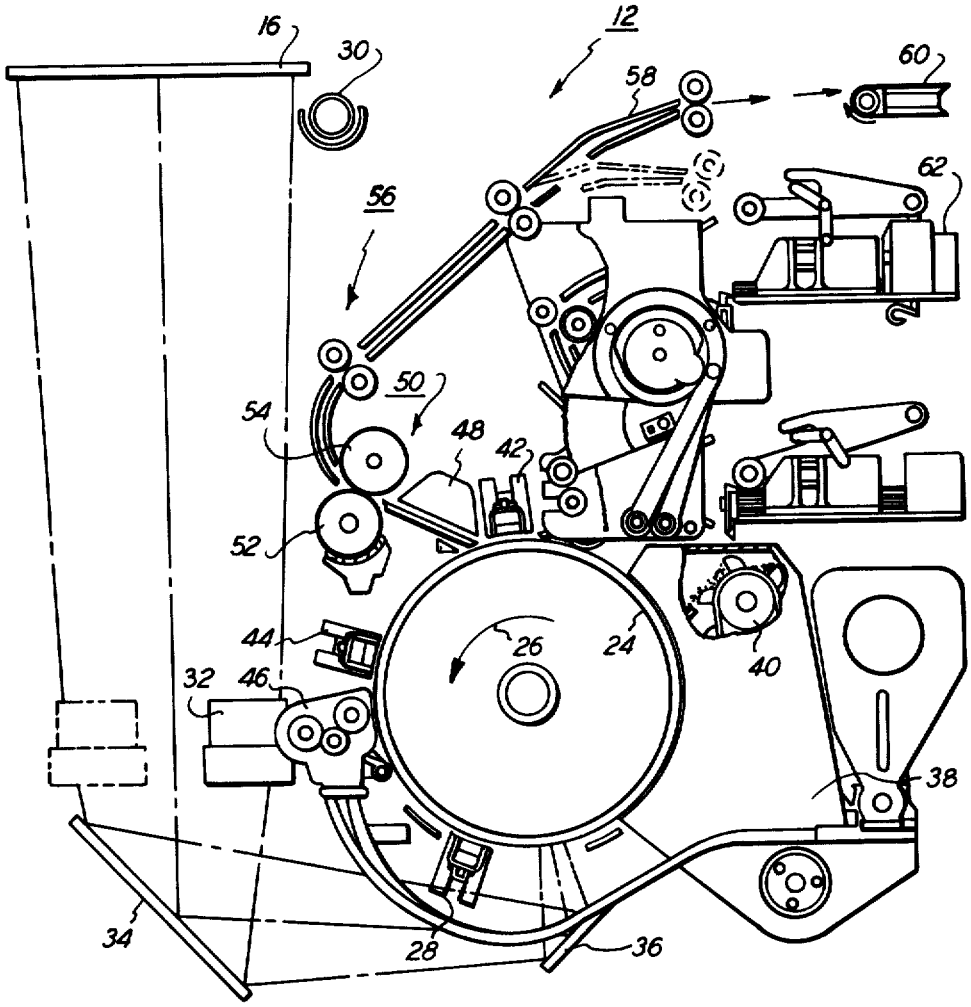
FIG. 3 is a schematic elevational view illustrating the FIG. 1 printing machine.
Figure 4:
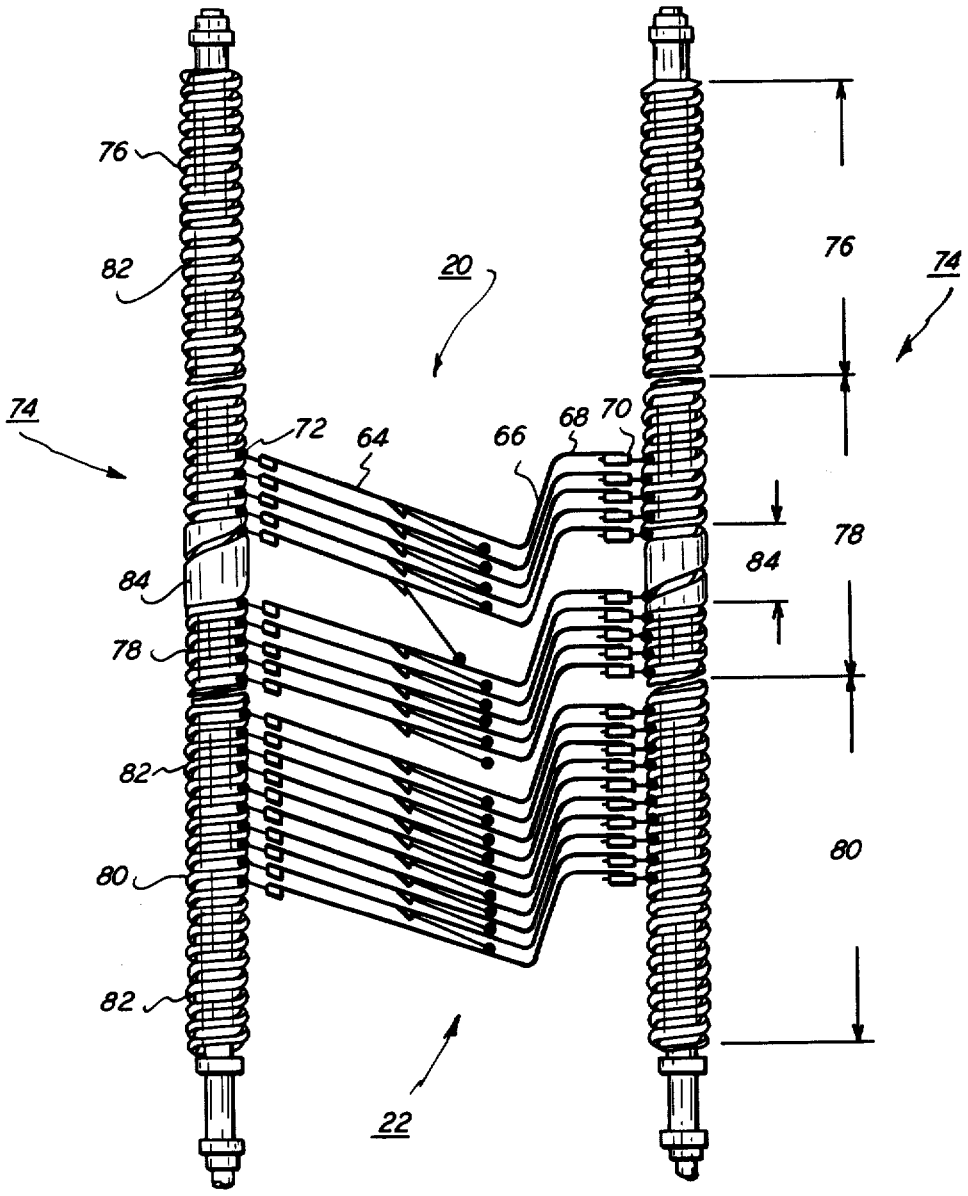
FIG. 4 is an elevational view showing the cam assembly moving the trays of the FIG. 1 sorting apparatus.

Referring now to FIG. 3, there is shown schematically the structure of electrophotographic printing machine 12. Inasmuch as the art of electrophotographic printing is well known, the various processing stations employed in the printing machine are shown schematically and their operation briefly described with reference thereto.

As shown in FIG. 3, electrophotographic printing machine 12 includes a drum 24 having the outer periphery thereof coated with a suitable photoconductive material. Preferably, drum 24 is made from a conductive substrate, such as aluminum, having the photoconductive material, e.g. a selenium alloy, deposited thereon. Drum 24 rotates in the direction of arrow 26 to pass through the various processing stations disposed thereabout.

Initially, drum 10 moves a portion of the photoconductive surface through charging station A. At charging station A, a corona generating device, indicated generally by the reference numeral 28, charges the photoconductive surface of drum 24 to a relatively high, substantially uniform potential. A suitable corona generating device is described in U.S. Pat. No. 2,836,725 issued to Vyverberg in 1958.

Thereafter, the charged portion of the photoconductive surface of drum 24 is advanced through exposure station B. At exposure station B, an original document is positioned facedown on transparent platen 16. The original document is scanned by a moving optical system so as to produce a flowing light image thereof. The optical system includes an elongated horizontally extending lamp 30 and a movable lens 32. The lamp and lens move in coordination with one another across platen 16 to focus successive bands of illumination reflected from the original document onto the moving photoconductive surface of drum 24 in synchronism therewith. The optical light path is folded by means of a pair of image mirrors 34 and 36 interposed between the lens and photoconductive surface of drum 24. Under the influence of the flowing light image, the uniformly charged photoconductive surface is selectively discharged in the nonimage area to record an electrostatic latent image on drum 24.

Next, drum 10 advances the electrostatic latent image recorded on the photoconductive surface to development station C. Development station C includes a developer housing 38 having a supply of developer material therein. Preferably, the developer material comprises carrier granules having toner particles adhering triboelectrically thereto. A bucket conveyor 40 advances the developer material from the bottom of developer housing 38 to the top thereof. The material is then cascaded downwardly into the active development zone. As the developer material flows downwardly over the upwardly moving photoconductive surface of drum 24, the electrostatic latent image attracts the toner particles from the developer mix. This forms a toner powder image on drum 24 corresponding to the informational areas of the original document being reproduced.

Drum 24 then transports the toner powder image developed on the photoconductive surface to transfer station D. At transfer station D, a sheet of support material is positioned in contact with the toner powder image deposited on the photoconductive surface of drum 24. The backside of the sheet of support material is sprayed with an ion discharge from a transfer corona generating device 42. This induces a charge on the sheet of support material having a polarity and magnitude sufficient to attract the toner powder image from the photoconductive surface of drum 24 to the sheet of support material.

Invariably, after the sheet of support material is separated from the photoconductive surface of drum 24, some residual particles remain adhering thereto. These residual particles are removed from drum 24 at cleaning station E. Preferably, cleaning station E includes a cleaning corona generating device 44 adapted to neutralize the electrostatic charge tending to hold the residual toner particles on the photoconductive surface of drum 24. The neutralized toner particles are then mechanically cleaned from the photoconductive surface by means of a brush or blade and the toner particles collected within housing 46.

After the sheet of support material has been removed from the photoconductive surface, a transport 48 advances the sheet of support material, with the toner powder image thereon, to fusing station F. Fusing station F includes a fuser assembly indicated generally by the reference numeral 50, having a heated fuser roller 52 and a back-up roller 54. Fuser roll 52 and back-up roll 54 coact so as to support the advancing sheet of support material in pressure driving contact therebetween. The heated surface of fuser roller 52 contacts the toner powder image on the surface of the sheet of support material. The pressure and heat permanently bond the toner particles to the sheet of support material in image configuration.

After leaving fuser 50, the sheet of support material with the toner powder image permanently affixed thereto advances along curvalinear sheet guides, indicated generally by the reference numeral 56, which have a plurality of spaced rollers for advancing the sheet therealong. Guide 58 of sheet guides 56 is movable to advance the sheet of support material to conveyor 60 or to upper sheet supply tray 62. Tray 62 is arranged to recirculate the sheet of support material for duplex copying. Conveyor 60 advances the sheet of support material to sorting apparatus 14.

It is believed that the foregoing description is sufficient for purposes of the present invention to illustrate the general operation of an electrophotographic printing machine coupled to the sorting apparatus of the present invention.

Sorting apparatus 14 comprises a horizontal vacuum transport assembly which receives copy sheets from conveyor 60 and advances them to a first group of sheet receiving members or trays 20, or a second group of sheet receiving members or trays 22. A drive system moves each group of tray assemblies vertically intermittently for receiving copy sheets along the transport path. Each group of trays includes approximately 10 trays. This facilitates multiple bin loading and unloading. Each tray includes a tray portion 64 inclined at approximately 20° to the horizontal, and an end portion 66 which is substantially perpendicular to tray portion 64 and then extends in a horizontal directon at tail portion 68. Tray portion 64 and tail portion 68 are mounted on cam followers 70 and 72, respectively, which engage the spiral slot formed in the elongated surface of cam members, indicated generally by the reference numeral 74. Each tray has three cam followers riding in the spiral grooves of three cam members. By this arrangement, a three point suspension is provided for the tray assemblies. Each of the cam members 74 is divided into three independently rotatable portions 76, 78, and 80. Portion 76 may include a plurality of low pitch surfaces 82 while portion 78 includes one high pitched surface 84 as well as low pitch surfaces 82. High pitch surface 84 is located adjacent the sheet loading zone or station so as to open the spacing between trays facilitating the loading of sheets therein. After the sheet is received in the tray assembly, the tray assembly is then closed to the normal gap.

Figure 5:
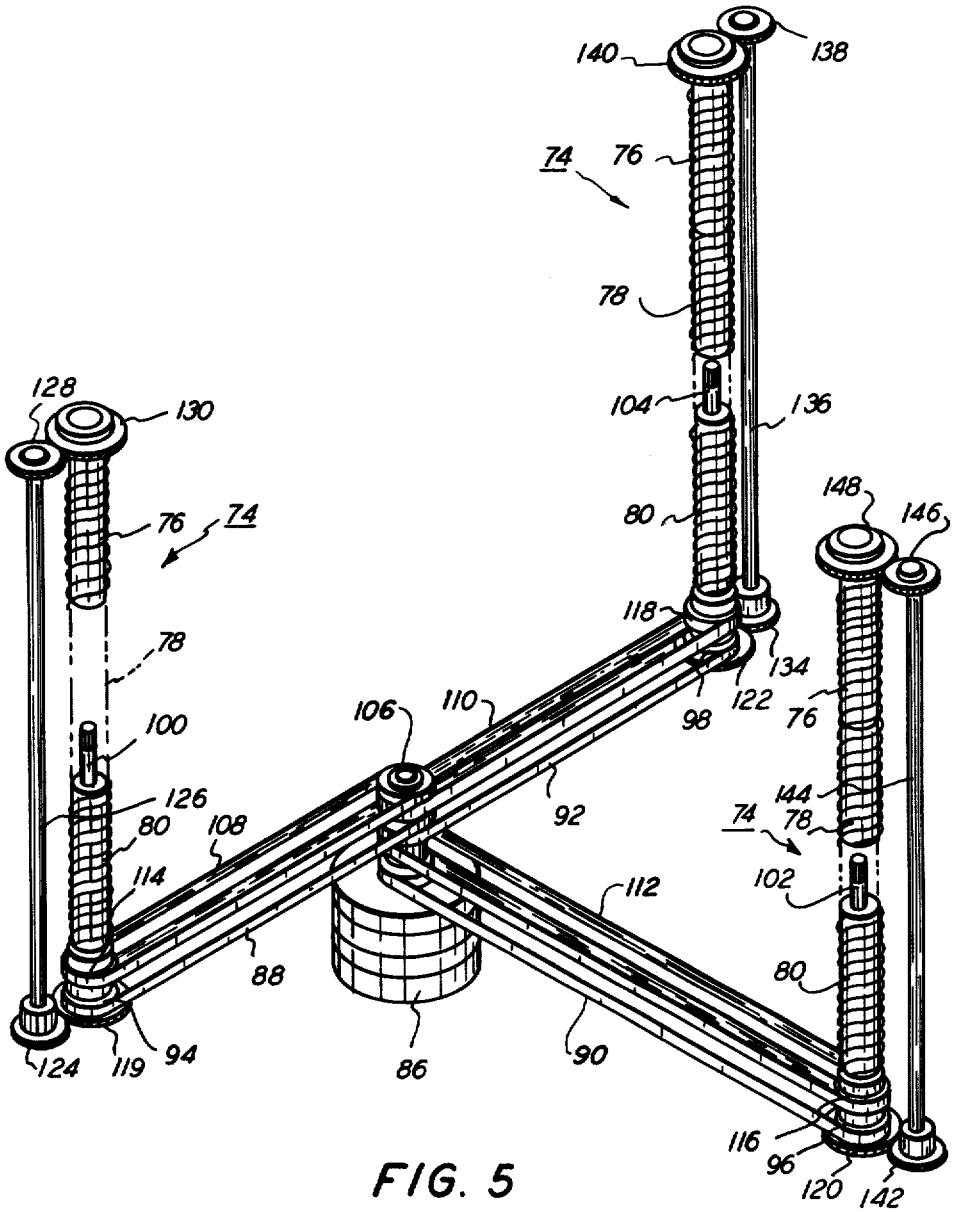
FIG. 5 is a fragmentary perspective view depicting the drive assembly of the FIG. 1 sorting apparatus.

Referring now to FIG. 5, the drive mechanism for moving the tray assemblies vertically will be described. The drive mechanism includes a drive motor 86 which drives six timing belts, one for each portion of cam member 74. Belts 88, 90, and 92, respectively, are entrained about pulleys 94, 96, and 98. Pulley 94 is connected to shaft 100. Pulley 96 is connected to shaft 102 and pulley 98 is connected to shaft 104. Portion 80 of each cam member 74 is hollow permitting shafts 100, 102, and 104 to pass therethrough. Shafts 100, 102, and 104 are pinned to the respective second portions 78 of cam members 74. Thus, rotation of motor 86 drives belts 88, 90, and 92 which, in turn, cause shafts 100, 102 and 104 to rotate so as to rotate the respective middle portions 78 of cam members 74. Clutch 106 couples motor 86 to belts 108, 110, and 112. Belt 108 is entrained about pulley 114 on first portion 80 of cam member 74. Belt member 112 is entrained about pulley 116 on first portion 80 of cam member 74. Belt 110 is entrained about pulley 118 secured to portion 80 of cam member 74. Gears 119, 120, and 122 are mounted on the respective portions 80 of cam members 74. Gear 119 meshes with gear 124 on shaft 126. Shaft 126 has a gear 128 on the end thereof opposed from gear 124. Gear 128 meshes with the gear 130 on portion 76 of cam member 74. In this manner, energization of clutch 106 couples motor 86 to belt 108. Belt 108 rotates portion 80 of cam member 74 and gear 119 thereon. Gear 119 rotates gear 124 which, in turn, drives shaft 126 and gear 128. Rotation of gear 128 drives gear 130 and rotates portion 76 of cam member 74. Thus, it is seen that portions 76 and 80 of cam member 74 rotates simultaneously with energization of clutch 106. Gear 122 meshes with gear 134 on shaft 136. Shaft 136 has a gear 138 on the end thereof opposed from gear 132. Gear 138 meshes with gear 140 on portion 76 of cam member 74. Thus, energization of clutch 106 couples drive motor 86 to belt 110. Belt 110 rotates portion 80 of cam member 74. As portion 80 rotates, gear 122 rotates therewith driving gear 134 and shaft 136. This, in turn, drives gear 138 which causes gear 140 to rotate. As gear 140 rotates, portion 76 of cam member 74 rotates therewith. Hence, actuation of clutch 106 causes drive motor 86 to rotate both portions 76 and 80 of cam member 74 simultaneously. Similarly, belt 112 rotates portion 80 of cam member 74. Gear 120 on portion 80 meshes with gear 142 on shaft 144. Shaft 144 has a gear 146 on the end thereof opposed from gear 142. Gear 146 meshes with gear 148 on portion 76 of cam member 74. Hence, rotation of gear 146 drives gear 148 which, in turn, drives portion 76 of cam member 74. It is, therefore, apparent that energization of clutch 106 also couples motor 86 to belt 112 which drives portion 80 and 76 of cam member 74 simultaneously.

Figure 6:
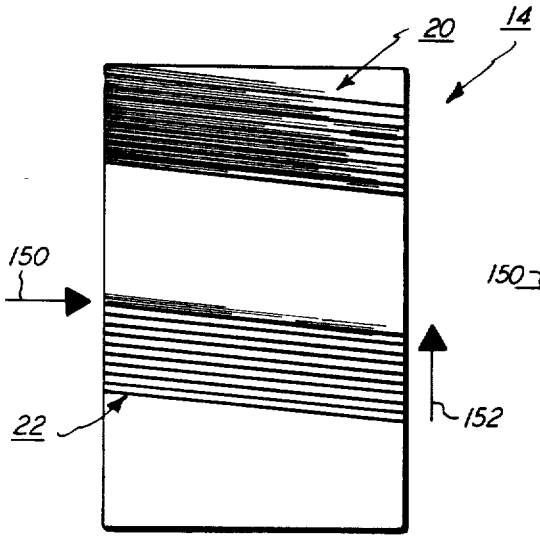
FIG. 6(*a*) is a schematic elevational view showing the sheets being loaded into one group of trays in the FIG. 1 sorting apparatus.
Figure 6:
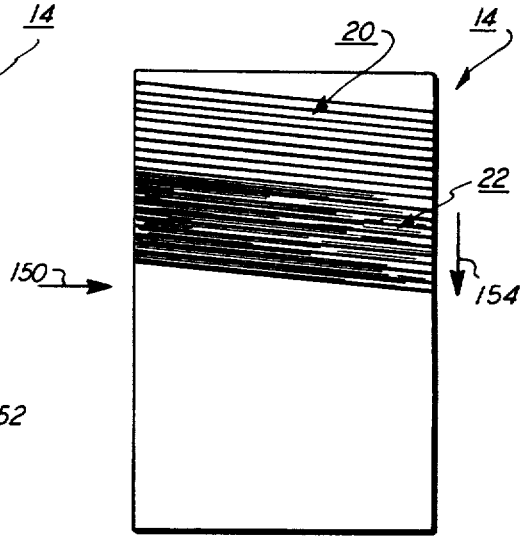
Figure 6:
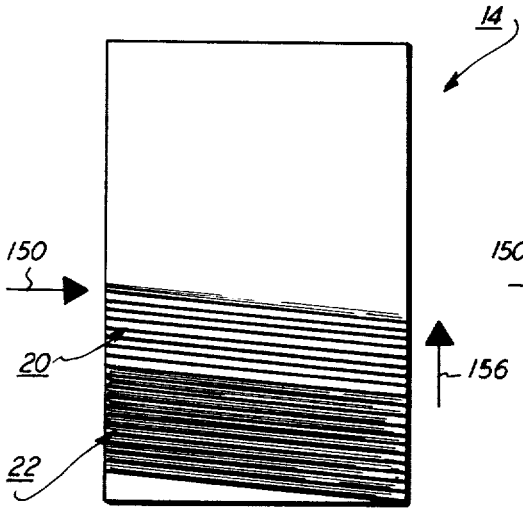
Figure 6:
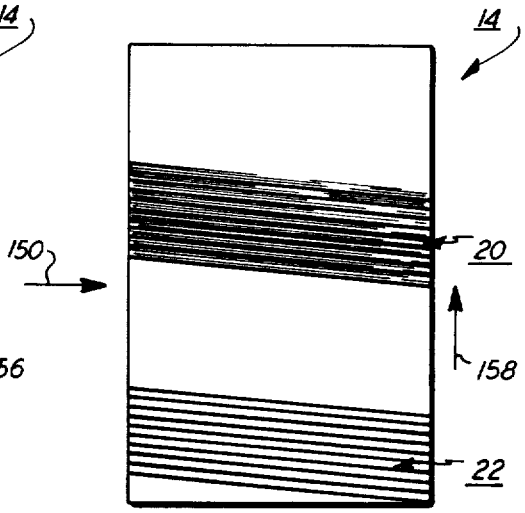

Referring now to FIGS. 6(*a*) through 6(*d*), there is shown the manner of operation of sorting apparatus 14. As depicted in FIG. 6(*a*), the copy sheet advances in the direction of arrow 150. With regard to FIG. 6(*a*), clutch 106 is de-energized and portions 76 and 80 of cam members 74 are non-rotating. Thus, the first group of trays 20 remains stationary. However, portion 78 of cam member 74 is rotating. This drives the second group of trays 22 in an upwardly direction, as indicated by arrow 152. As each tray of group 22 passes the sheet path, indicated by arrow 150, a sheet is loaded therein. Thus, it is seen that the first group of trays 22 moves in an upwardly direction in the loading station to receive copy sheets therein. After the last tray has received a copy sheet, control logic reverses the direction of motor 86 and clutch 106 is energized.

As shown in FIG. 6(*b*), this drives tray groups 20 and 22 in a downwardly direction as indicated by arrow 154. When the first tray of group 20 passes the sheet receiving position, as indicated by arrow 150, the machine logic once again reverses the direction of rotation of motor 86 and de-energizes the clutch 106. At this time, the groups of trays are positioned as shown in FIG. 6(*c*).

Turning now to FIG. 6(*c*), only portion 78 will rotate driving the first group of trays 20 in the direction of arrow 156 while the second group of trays 22 having the copy sheets therein remains stationary. This permits the machine operator to remove the copy sheets from the second group of trays 22 as copy sheets are being loaded into the first group of trays 20.

Turning now to FIG. 6(*d*), group 20 is depicted with the last tray thereof having received a copy sheet. At this time, the machine logic actuates clutch 106 and portions 76, 78, and 80 of cam member 74 rotate driving both tray groups 20 and 22 in the direction of arrow 158. The first group of trays 20 return to the unloading position, as shown in FIG. 6(*a*), and the second group of trays 22 moves to the loading position. It is thus seen that each group of trays has its own dedicated unloading station while using a common sheet loading station. Moreover, sheets are unloaded from one group of trays as they are being loaded into the other group of trays. In this manner, the sorting apparatus is limitless in capacity and operates in a rapid and efficient manner.

In recapitulation, it is evident that the sorting apparatus of the present invention comprises two groups of trays. One group of trays is receiving sheets at the common loading station with the other group of trays having sheets unloaded therefrom at a dedicated unloading station. After loading and unloading the sheets in the respective groups of trays, the process is reversed. Thus, the sorting apparatus of the present invention is limitless in capacity so as to readily enable an operator to perform an additional operation, i.e. stapling or stitching the collated sets of copies, simultaneously with new sets of copies being loaded into the varous trays of the sorting apparatus.

It is, therefore, evident that there has been provided in accordance with the present invention, an apparatus for sorting sheets that fully satisfies the objects, aims, and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for sorting sheets, including:

at least two groups of sheet receiving members, each of said two groups of sheet receiving members comprsing a series of individual sheet receiving members aranged to receive sheets, each of said two groups of sheet receiving members include a vertically extending array of closely spaced tray members;

a sheet loading station arranged to advance sheets into said individual sheet receiving members of said two groups of sheet receiving members;

at least two sheet unloading stations, one of said two sheet unloading stations being arranged to have one of said two groups of sheet receiving members positioned thereat for removing the sheets therefrom, and the other of said two sheet unloading stations being arranged to have the other of said two groups of sheet receiving members positioned thereat for removing the sheets therefrom; said one of said two sheet unloading stations being spaced from said other of said two sheet unloading stations; and means, coupled to said two groups of sheet receiving members, for moving said one of said two groups of sheet receiving members to said one of said two sheet unloading stations with said other of said two groups of sheet receiving members being moved to said sheet loading station so as to bring said individual sheet receiving members of said other of said two groups of sheet receiving members into position for receiving sheets at said sheet loading station, said moving means being arranged to move said other of said two groups of sheet receiving members to said other of said two sheet unloading stations with said one of said two groups of sheet receiving members being moved to said sheet loading station so as to bring said individual sheet receiving members of said one of said two groups of sheet receiving members into position for receiving sheets at said sheet loading station, thereby loading and unloading each of said two groups of sheet receiving members, said moving means comprising a frame, at least one vertically extending cam member supported by said frame, said cam member being divided into at least three independently rotatable portions with the first portion of said cam member being positioned adjacent said one of said two sheet unloading stations, the second portion of said cam member being positioned adjacent said sheet loading station, and the third portion of said cam member being positioned adjacent said other of said two sheet unloading stations, said cam member being coupled to said array of tray members of said two groups of sheet receiving members so as to move said tray members, first means for rotating the first portion of said cam member and the third portion of said cam member in unison with one another, and second means for rotating the second portion of said cam member independent of the first portion of said cam member and the third portion of said cam member.

2. An apparatus as recited in claim 1, wherein said sheet loading station is interposed between said two sheet unloading stations.

3. An apparatus as recited in claim 1, wherein said first rotating means and said second rotating means are reversible.

4. A reproduction system of the type in which information on original documents is reproduced on sheets that are distributed for sorting into collated sets, wherein the improved sorting apparatus includes:

at least two groups of sheet receiving members, each of said two groups of sheet receiving members comprising a series of individual sheet receiving members arranged to receive sheets, each of said two groups of sheet receiving members include a vertically extending array of closely spaced tray members;

a sheet loading station arranged to advance sheets into said individual sheet receiving members of said two groups of sheet receiving members;

at least two sheet unloading stations, one of said two sheet unloading stations being arranged to have one of said two groups of sheet receiving members positioned thereat for removing the sheets therefrom, and the other of said two sheet unloading stations being arranged to have the other of said two groups of sheet receiving members positioned thereat for removing the sheets therefrom; said one of said sheet unloading stations being spaced from said other of said sheet unloading stations; and means, coupled to said two groups of sheet receiving members, for moving said one of said two groups of sheet receiving members to said one of said two sheet unloading stations with said other of said two groups of sheet receiving members being moved to said sheet loading station so as to bring said individual sheet receiving members of said other of said two groups of sheet receiving stations into position for receiving sheets at said sheet loading station, said moving means being arranged to move said other of said two groups of sheet receiving members to said other of said two sheet unloading stations with said one of said two groups of sheet receiving members being moved to said sheet loading station so as to bring said individual sheet receiving members of said one of two groups of sheet receiving members into position for receiving sheets at said sheet loading station, thereby loading and unloading each of said two groups of sheet receiving members, said moving means comprising a frame, at least one vertically extending cam member supported by said frame, said cam member being divided into at least three independently rotatable portions with the first portion of said cam member being positioned adjacent said one of said two sheet unloading stations, the second portion of said cam member being positioned adjacent said sheet loading station, and the third portion of said cam member being positioned adjacent said other of said two sheet unloading stations, said cam member being coupled to said array of tray members of said two groups of sheet receiving members so as to move said tray members, first means for rotating the first portion of said cam member and the third portion of said cam member in unison with one another, and second means for rotating the second portion of said cam member independent of the first portion of said cam member and the third portion of said cam member.

5. A reproduction system as recited in claim 4, wherein said sheet loading station is interposed between said two sheet unloading stations.

6. A reproduction system as recited in claim 4, wherein said first rotating means and said second rotating means are reversible.

* * * * *